US007287787B1

(12) United States Patent
Tannone

(10) Patent No.: US 7,287,787 B1
(45) Date of Patent: Oct. 30, 2007

(54) LINEAR THUMB-PIECE ACTUATION LATCH MECHANISM

(75) Inventor: Brett E Tannone, Newtown, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 11/657,879

(22) Filed: Jan. 24, 2007

(51) Int. Cl.
*E05B 3/00* (2006.01)
*E05C 1/02* (2006.01)

(52) U.S. Cl. ..... 292/336.3; 292/137; 70/107; 70/471

(58) Field of Classification Search ..... 292/347, 292/336.3, 137, 169.19, DIG. 61, DIG. 54, 292/DIG. 64; 70/107–111, 208, 210, 224, 70/483–485, 467, 471, 489
See application file for complete search history.

(56) References Cited

U.S. PATENT DOCUMENTS 3,097,007 A * 7/1963 Eichacker et al. ..... 292/92
3,234,764 A * 2/1966 Russell et al. ..... 70/153
4,123,097 A 10/1978 Allemann
4,502,720 A 3/1985 Fayerman et al.
4,779,909 A 10/1988 Hennessy
4,925,222 A 5/1990 Loock
4,982,986 A 1/1991 Gressett, Jr. et al.
4,988,136 A * 1/1991 Gressett, Jr. ..... 292/336.3
5,060,991 A * 10/1991 Davidian et al. ..... 292/172

* cited by examiner

*Primary Examiner*—Jennifer H. Gay
*Assistant Examiner*—Alyson M. Merlino
(74) *Attorney, Agent, or Firm*—DeLio & Peterson, LLC

(57) ABSTRACT

This invention provides a thumb-piece door latch mechanism which has ergonomic features, is modular and can be used with any escutcheon, can be used with all type locks, and which in the locked door mode provides greater resistance to abusive attack of the door latch mechanism and makes the thumb-piece and latch mechanism more durable and less susceptible to vandalism. The thumb-piece moves linearly up and down and is connected to a thumb-piece guide plate which likewise moves up and down when the thumb-piece is moved. A permissive spring having one end connected to a spindle turn plate and the other end connected to the guide plate moves a rotatably mounted spindle, which in turn rotates a spindle tail and a latch connected to the spindle tail. The permissive spring provides greater resistance to abusive attacks of the door lock and mechanism.

5 Claims, 10 Drawing Sheets

LINEAR THUMB-PIECE ACTUATION LATCH MECHANISM

BACKGROUND OF THE INVENTION

1. Field of the Invention

This invention relates generally to door latch mechanisms and, more particularly, to an outside thumb-piece door latch mechanism which has ergonomic features, is modular and can be used with any escutcheon, can be used with all type locks and which in the locked door mode provides greater resistance to abusive attack of the door latch mechanism and makes the thumb-piece and latch mechanism more durable and less susceptible to vandalism.

2. Description of Related Art

A common way to withdraw the latch bolt of a locked door is by rotation of a knob which when turned translates the rotational motion into linear motion for retracting or extending the door latch bolt from the door frame.

For some doors it is preferred to use a door handle in conjunction with a thumb-piece for pulling back the latch bolt from engagement with the frame before the door can be pulled open. The thumb-piece is typically of the pivot type which is stressful on the user's thumb when operating the door mechanism. In the instant invention the thumb piece may be moved linearly up and down and the linear motion is translated into a transverse back and forth horizontal linear motion for withdrawing the latch bolt from the door frame. The latch bolt is normally extended into the door frame. The linear up and down motion of the thumb-piece provides a mechanism which is ergonomic, i.e., less stressful on the user.

Thumb-piece actuators are well known in the art and it is a problem that in the locked door mode (the door latch bolt cannot be retracted) a person trying to open the door may subject the thumb-piece to abusive attack such as banging which can lead to damaging the door locking mechanism. This is particularly a problem with regard to vandalism or to an illegal entry through the door and it is necessary to provide an improved thumb-piece door latch mechanism which is more resistant to abusive attack, durable, and less susceptible to vandalism.

Door handles with thumb pieces are numerous and extremely varied and most are complex and commonly need numerous parts increasing the number of factory operations and complicating the positioning of parts in the structure. Gear action has been resorted to but is an expensive construction. Other mechanical devices using shafts, levers, cams, and bell cranks also take up considerable space and require relatively large and bulky housing thereby adding to the initial cost and increased installation costs.

Bearing in mind the problems and deficiencies of the prior art, it is therefore an object of the present invention to provide a door latch mechanism which uses a thumb-piece to extend and retract a door latch from a door frame, which mechanism is of a design having ergonomic features, is modular, of simple construction and provides enhanced resistance to abusive attack making the mechanism durable and less susceptible to vandalism. For convenience the following description will be directed to a thumb piece which moves linearly up and down but it will be appreciated to those skilled in the art that a pivoted thumb piece may also be used where an ergonomic design is not desired.

Still other objects and advantages of the invention will in part be obvious and will in part be apparent from the specification.

SUMMARY OF THE INVENTION

The above and other objects and advantages, which will be apparent to those skilled in the art, are achieved in the present invention which is directed to, in a first aspect, a thumb-piece latch mechanism comprising:

- an inner plate and an outer plate which plates are secured together with a latch mechanism therebetween;
- a thumb-piece extending into the inner plate and secured to a glide plate in the latch mechanism and which thumb-piece moves linearly up and down;
- a thumb-piece glide plate moveable linearly up and down in the latch mechanism with the thumb-piece when the thumb-piece is moved up and down, respectively;
- a spindle rotably mounted to the inner plate;
- a spindle turn plate secured to the spindle and which rotates when the spindle is rotated;
- a permissive spring having one end connected to the spindle turn plate and the other end connected to the thumb-piece glide plate;
- a spindle tail secured to the spindle in the same plane and which rotates when the spindle is rotated; and
- a latch connected to the spindle tail which moves a latch bolt transversely to the spindle tail when the spindle tail is rotated;
- wherein when the thumb-piece is depressed the thumb-piece glide plate is moved downward and the spindle turnplate is rotated rotating the spindle and the spindle tail thereby moving the latch bolt transversely from the door frame.

In another aspect of the invention, the spindle turn plate is configured to permit either clockwise rotation and counter-clockwise rotation for moving a latch bolt leftward or rightward, respectively.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-10 of the drawings in which like numerals refer to like features of the invention.

Broadly stated, the door latch mechanism of the invention uses a thumb-piece which is connected to a thumb-piece glide, which, when the thumb-piece is linearly depressed, the glide moves in a downward motion transferring this motion through a permissive spring to a spindle hub. In the unlocked door mode, the spindle hub is allowed to rotate freely and rotates a spindle which retracts the door latch. In the locked door mode, the spindle hub motion is restricted but the thumb-piece is allowed to move freely up and down with the extension of the permissive spring. This results in a greater resistance of the door latch mechanism to withstand abusive attack or vandalism. The linear motion of the thumb-piece is also an ergonomic feature of the invention making the locking mechanism easier to use by the user of the lock.

Figure 1:
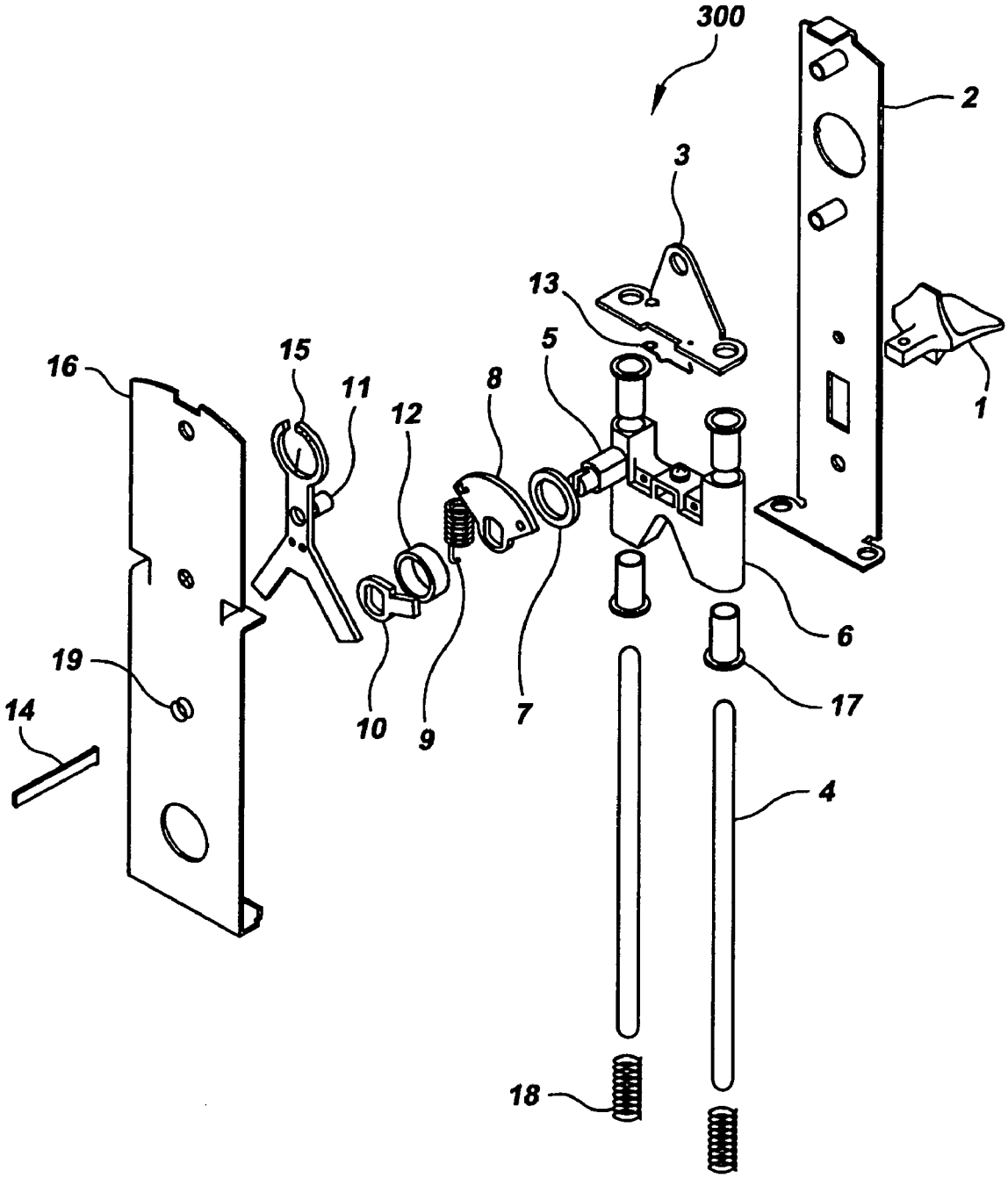
FIG. 1 is an exploded perspective view of a door latch mechanism of the invention with a thumb-piece for mounting on the surface of a door, which mechanism provides greater resistance to abusive attack, is durable and less susceptible to vandalism.
Figure 10:
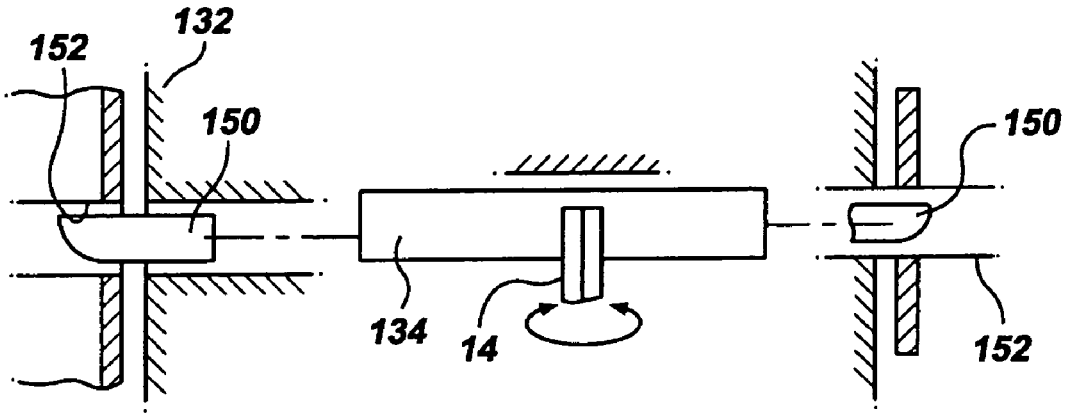
FIG. 10 is a diagrammatic view of the spindle of the FIG. 1 mechanism in door latch operating position.

Referring now to FIG. 1, an exploded view of the door latch mechanism of the subject invention is shown as numeral 300. In general, a thumb-piece 1 cooperates with a thumb-piece glide 6 which guide is held in the mechanism by a top glide support 3. The thumb-piece glide 6 has a plurality of cylindrical linear bearings 17 which permit free movement of two (2) thumb-piece rails 4 in an upward and downward motion in vertical through openings in the thumb-piece glide. Compression springs 18 are provided at the base of the thumb-piece rails to facilitate an upward biased motion of the thumb-piece glide, so that the thumb-piece and latch are in the normal latched door position. A spindle hub 5 is rotatably connected to the inner plate 2 and cooperates with spindle turn plate 8. When the thumb-piece 1 is depressed, the thumb-piece glide 6 is depressed and permissive spring 9 (shown here as a preferable coil spring) which is connected to spindle turn plate 8 and thumb-piece glide 6 rotates the spindle hub 5. A spindle tail 14 connected to the spindle hub 5 likewise rotates actuating a conventional latch mechanism opening the door latch (as shown in FIG. 10). A spindle locking tail 10 is provided on the spindle hub 5 and cooperates with locking tail 15 to prevent extension or retraction of the door latch when the door is locked and the thumb-piece is depressed. The mechanism is contained between inner plate 2 and outer plate 16 which are secured together by bolts as discussed below.

Figure 2:
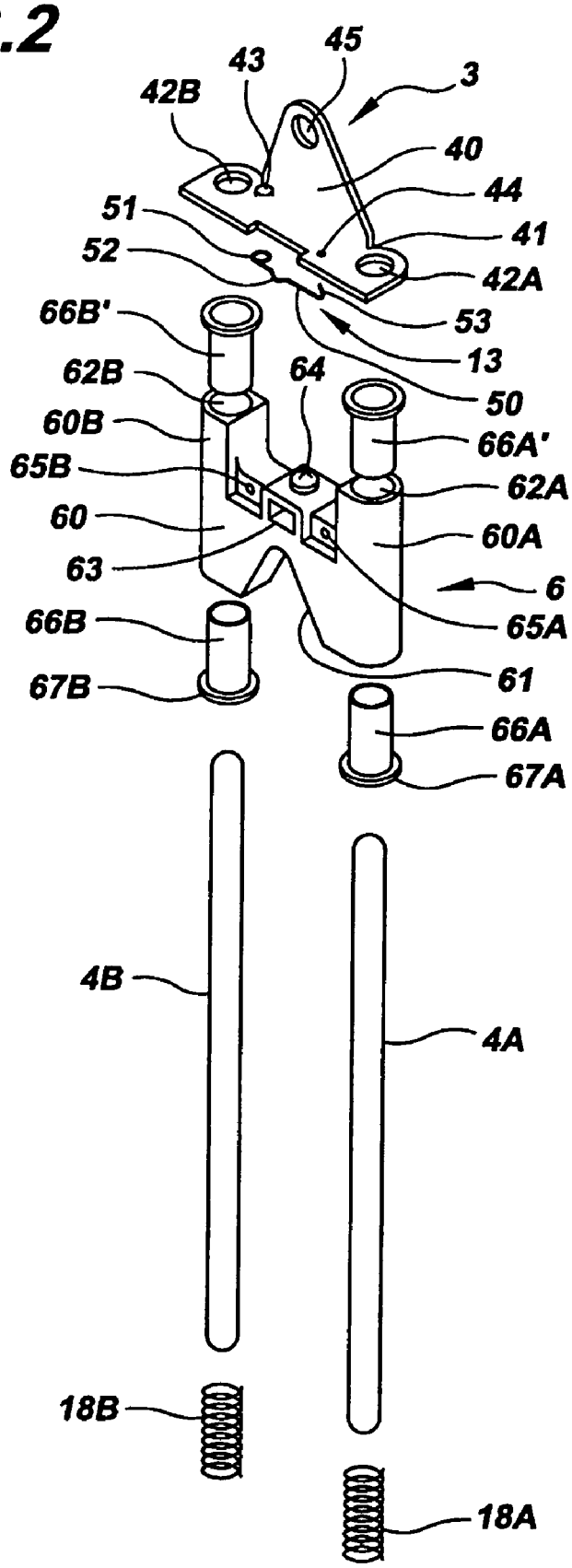
FIG. 2 is an exploded perspective view of the top glide support and thumb-piece glide used in the mechanism of the invention.

Referring now to FIG. 2, a detailed perspective view of the thumb-piece glide 6 is shown. The thumb-piece glide 6 comprises a generally rectangular body 60 having a lower V-shaped cutout 61 and two outer arms 60A and 60B. Cylindrical through holes 62A and 62B are provided at each end of the thumb-piece glide body 60 in outer arms 60A and 60B and linear bearings 66A, 66A', 66B, and 66B' are positioned in the through openings to facilitate motion of the thumb-piece rails 4A and 4B therethrough. The linear bearings have shoulders 67A, 67A', 67B, and 67B' to hold the bearings in position in the through openings.

The thumb-piece glide body 60 has a central rectangular horizontal through slot opening 63. A screw or other fastener 64 communicates with the opening 63 to secure, as will be described further hereinbelow, the nose of the thumb-piece 1 in the opening 63. The thumb-piece glide body 60 also has permissive spring crank openings 65A and 65B which are used to hold one crank end of the permissive spring 9 to facilitate rotational movement of the spindle hub when the thumb-piece is actuated (moved downward).

Compression springs 18A and 18B are compressed when the thumb-piece glide is depressed and facilitate up and down motion of the thumb-piece glide body 60 and thumb-piece in the mechanism. The springs bias the mechanism in the upward position so that the thumb-piece is in the upward position and the door latch in the extended locked position in the door frame.

The thumb-piece glide body 60 is held in position in the door latch mechanism by top glide support 3. The top glide support 3 comprises a vertical portion 40 and an inward transverse portion 41. The transverse portion 41 has through openings 42A and 42B through which the thumb-piece rails 4A and 4B extend and move through respectively. The top glide support upper portion 40 has a through opening 45 to fit over a flange 34A securing the top glide support 3 in the mechanism. The transverse portion 41 of the top guide support has a threaded opening 43 and a spaced apart spring opening 44. A locking position spring 13 is shown having a body portion 50 which at one end has a loop 51 and at the other end an upward extension 53. The spring body also has an outward center protrusion 52 which is used to facilitate holding the locking tail 15 in either the locked or unlocked position. In use, a fastener such as a screw is used to secure the locking position spring to the top glide support through loop 51 with the spring extension end 53 extending into opening 44.

Figure 3:
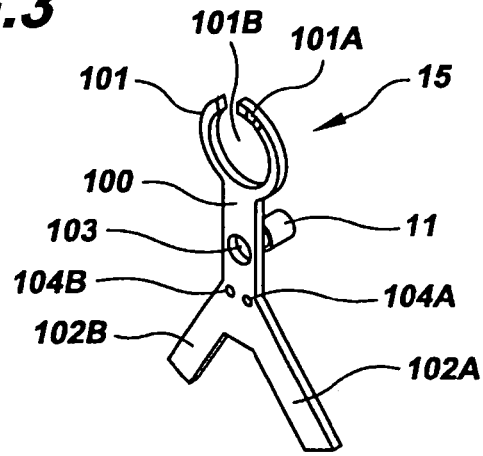
FIG. 3 is a perspective view of a conventional locking tail of the prior art which may be used with the door latch mechanism of the present invention.

Referring now to FIG. 3, a perspective view of the locking tail 15 is shown. Locking tail 15 comprises an elongated locking tail body 100 having a circular top 101 with a scored portion 101A and a through opening 101B. The locking tail body has a lower outward angled right leg 102A and a lower outward angled left leg 102B and a through opening 103 for securing the locking tail in the mechanism on flange 34B. Through openings 104A and 104B are provided to cooperate with the protrusion 52 on the locking position spring 13 to hold the locking tail 15 in the desired position. A locking tail spacer 11 is provided to facilitate holding the locking tail body in the mechanism.

Figure 4:
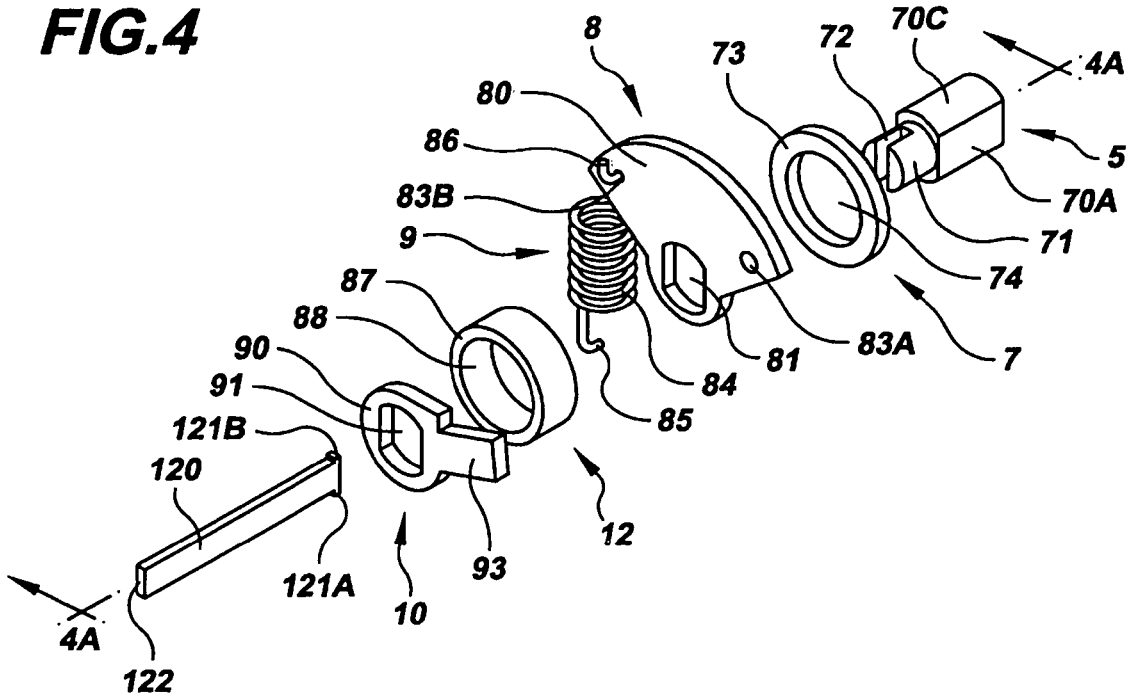
FIG. 4 is an exploded perspective view of the latch mechanism of the invention which converts the linear up and down motion of the thumb-piece and thumb-piece glide into rotational energy for a spindle tail and comprises a spindle hub, a spindle turn plate employing a permissive coil spring, a spindle locking tail which cooperates with a locking tail to allow locking of the door, whereby the thumb-piece may be moved when the door is in the locked position without damaging the door latch mechanism.

Referring now to FIG. 4, an exploded view of the spindle hub 5 and the parts that cooperate with the spindle hub are shown. The spindle hub 5 is elongated and shown having straight vertical sides 70A and 70B and curved upper sides 70C and 70D. The spindle hub has a circular extension 71 having a vertical slot 72 therein. A spindle spacer 7 having a circular body 73 and a through opening 74 fits over the curved upper sides 70A and 70B of spindle hub 5. Also fitting over the spindle hub 5 is the spindle turn plate 8 which has a fan-shaped upper portion 80 and a through opening 81 in the lower portion which is configured to fit snuggly over the spindle hub 5. The spindle turn plate 8 also has through openings 83A and 83B into which an extension of the permissive spring 9 is secured to connect the spring to the spindle turn plate. The permissive spring 9 has a coil spring body 84 and a bottom crank extension 85 and a top crank extension 86. As shown in FIG. 4, the top crank extension 86 fits into opening 83B of spindle turn plate 8. Note that the crank extension can fit into opening 83A to permit clockwise rotation of the spindle turn plate. In this configuration the lower crank 85 would fit into opening 65B of glide body 60.

A large spindle spacer 12 having a cylindrical body 87 and a through opening 88 would then also fit over the spindle hub 5 and spindle lock tail 10 fits snuggly on the spindle hub 5. Spindle lock tail 10 comprises a flat member 90 having a through opening 91 and an extension 93. The spindle tail 14 is secured in slot 72 and has an elongated body 120 and leg extensions 121A and 121B at the secured end and the free end is shown as numeral 122. The spindle tail body 120 would fit into a conventional latch mechanism in the door frame which, when body 120 is rotated, retracts or extends the latch mechanism from the door frame. This is shown in FIG. 10.

Figure 4A:
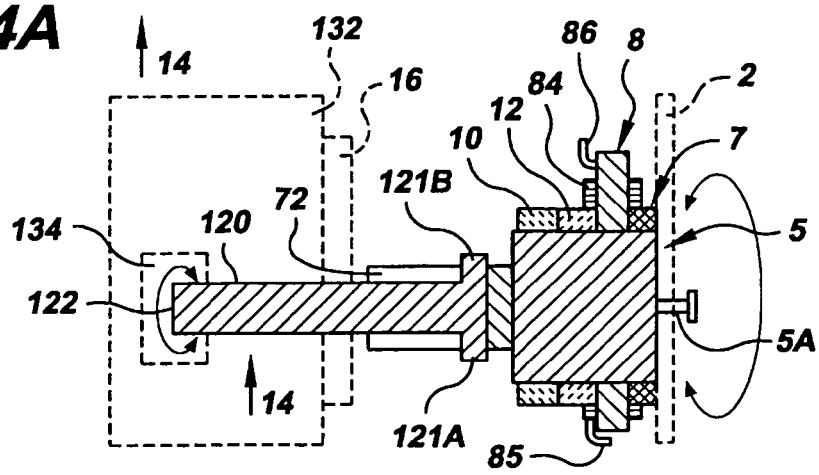
FIG. 4A is a cross-sectional view of FIG. 4 taken along lines 4A-4A.

FIG. 4A is a cross-sectional view of FIG. 4 showing the spindle hub and associated components assembled. As can be seen from FIG. 4A, when spindle hub 5 rotates, the spindle tail body 120 also rotates. As is conventional in the art, the spindle tail is connected to a latch mechanism which when the spindle tail is turned the latch is retracted from the latch plate of the door frame. It should be noted also in FIG. 4A that permissive spring 84 is connected at its upper end to the spindle turn plate 8 by crank 86 of spring 84. At the other end of spring 84, crank 85 will be inserted into opening 65B or 65A of thumb piece glide 6 as shown in FIG. 2. As will be more fully discussed hereinbelow, when the thumb-piece guide 6 is moved downward by movement of the thumb-piece, the spindle turn plate 8 is rotated which in turn rotates spindle hub 5 and spindle tail 14 retracting the latch from the door frame. Spindle hub 5 is rotatably secured to inner plate 2 (in phantom) by pin 5A. Outer plate 16 is shown in phantom as is door 132. A door latch mechanism is shown as numeral 134.

Figure 5A:
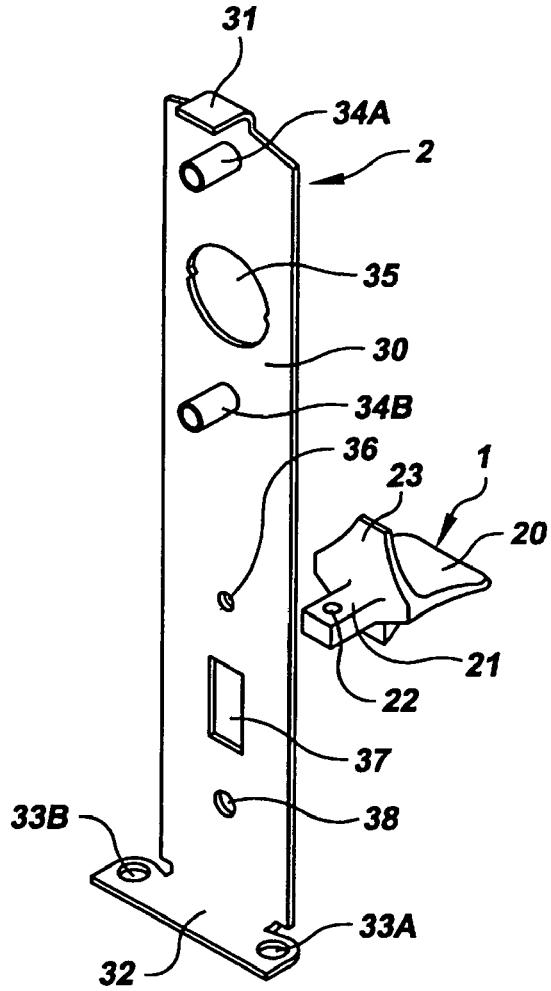
FIG. 5A is a perspective view of the thumb-piece and an inner cover plate for the latch mechanism of the invention.
Figure 5B:
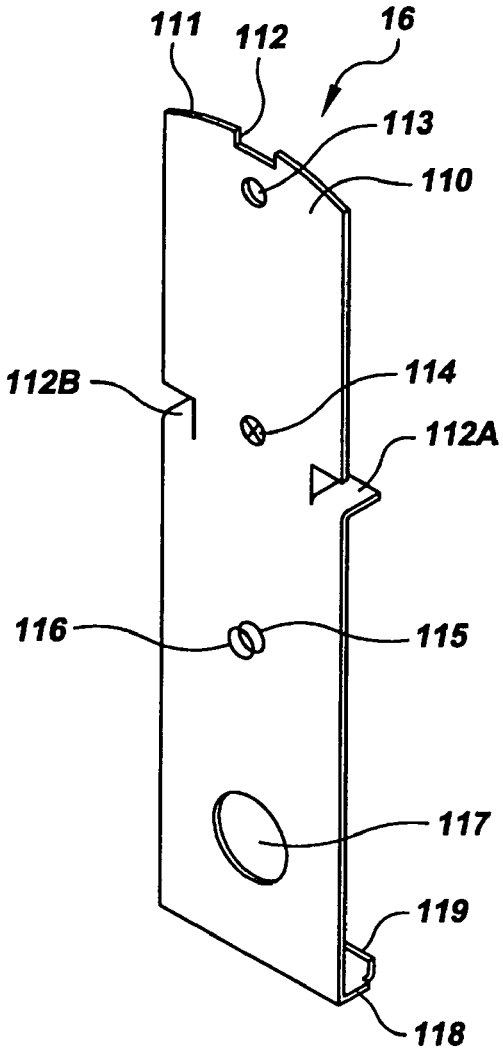
FIG. 5B is a perspective view of the outer cover plate for the latch mechanism of the invention.

FIGS. 5A and 5B show the thumb-piece inner plate 2 and thumb-piece outer plate 16, respectively. These two plates contain the mechanism of the invention therebetween and are secured together by bolts extending into flanges 34A and 34B.

The thumb-piece inner plate 2 comprises a flat elongated member 30 having an inward turned projection 31 at the upper curved end and an inward turned projection 32 at the lower end. The lower end 32 has openings 33A and 33B for holding the thumb-piece rails 4A and 4B in vertical alignment. The frame 30 has two inward flanges 34A and 34B for holding the inner plate 2 to the outer plate 16 thus securing the door latch mechanism together. The inner plate also has an opening 35 to hold a conventional locking mechanism as shown hereinbelow. The frame has a through opening 36 to rotatably couple the spindle hub 5 to the frame. A rectangular through opening 37 is provided to hold the nose 21 of the thumb-piece 1 and to allow movement of the thumb-piece 1 up and down within the opening 37. The thumb-piece 1 has a thumb portion 20, a central shoulder 23, and a nose portion 21. Referring also to FIG. 2, the nose portion 21 fits within opening 37 and is secured to the thumb-piece glide 6 in opening 63 with screw 64 which extends through the opening 22 in the nose portion of the thumb-piece.

Figure 6A:
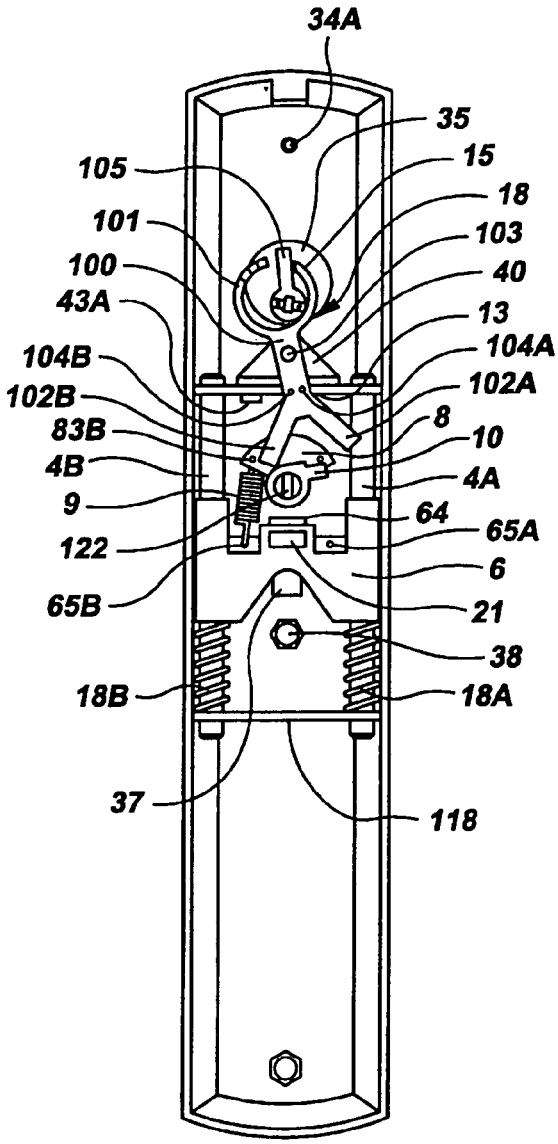
FIG. 6A is a front view of the door latch mechanism of the invention, without the outer plate, in the unlocked position with the thumb-piece in its normal door latch extended locked position.
Figure 6B:
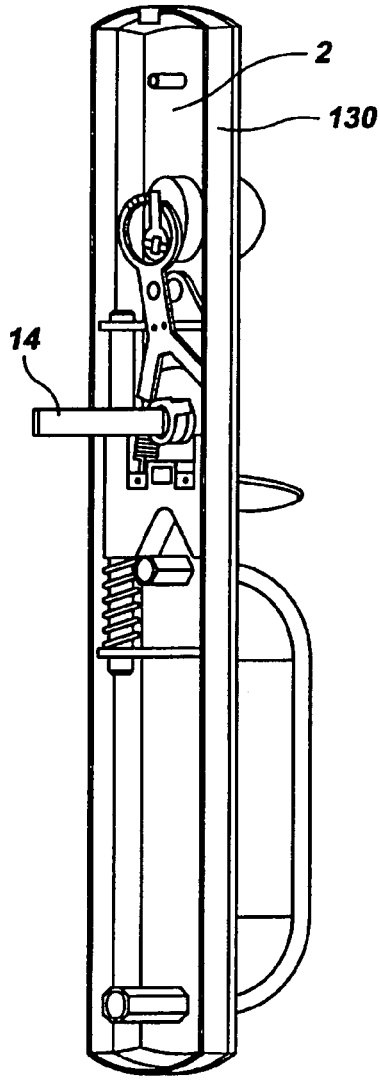
FIG. 6B is a perspective view of FIG. 6A.
Figure 6C:
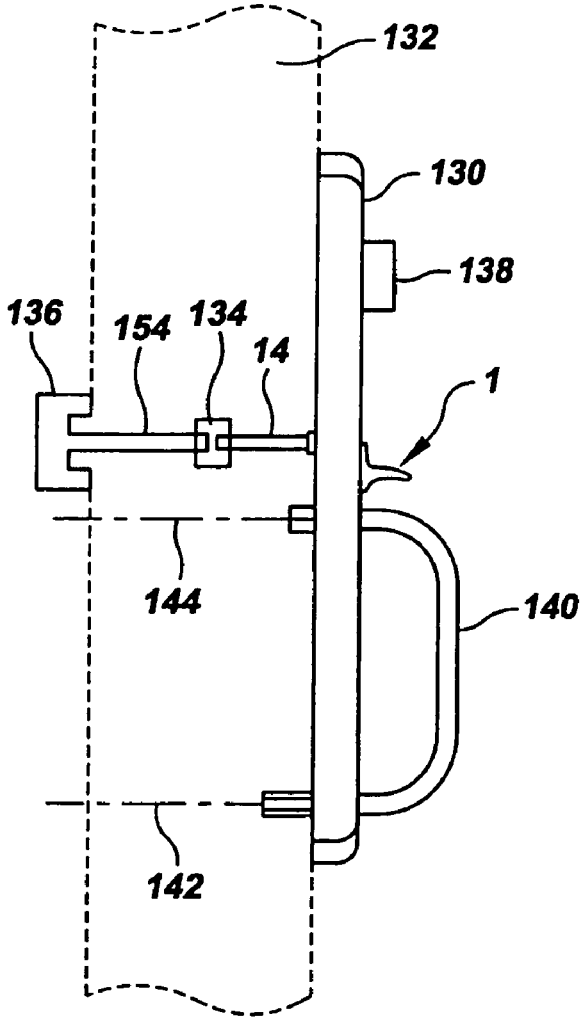
FIG. 6C is a side view of the mechanism of the invention mounted on a door.

Another opening 38 is provided in the inner plate to communicate with opening 117 in the outer plate 16 to provide clearance for a hex bolt which communicates with opening 38 and one end of the door handle as shown in FIGS. 6A and 6B. The hex bolts are used to secure the door handle to the door as shown in FIG. 6C.

The flat portion 32 of inner plate 2 rests on lip 119 of inward portion 118 of the outer plate 16. The outer plate 16 comprises a flat elongated section 110 having a curved top 111 and a cutout 112. Inward turned projection 31 fits into opening 112 of outer plate 16 and openings 113 and 114 cooperate with flanges 34A and 34B on the inner plate to secure the inner plate and outer plate together and to hold the door latch mechanism therebetween. Inward bent section 112A and 112B fit along the edges of inner plate 2 to provide additional structural support. An opening 115 is provided which holds a retaining ring 116 for the spindle tail 14.

FIG. 6A shows the door latch mechanism of the invention in the normal latched position. The spindle tail end 122 is vertically oriented. The door is unlocked and the thumb-piece can be moved up and down to withdraw the latch from the latch frame. In FIG. 6A the thumb-piece is in its upward position and the latch is extended into the latch frame keeping the door closed. It can be seen that the spindle locking tail 10 can rotate when the thumb-piece is depressed since there is no restriction from legs 102A and 102B of the locking tail 15.

Also referring to FIG. 6A the nose 21 of thumb-piece 1 is secured in the thumb-piece glide 6 by screw 64.

Referring now to FIG. 6B, the inner plate 2 and the latch mechanism of the subject invention is shown positioned in outer cover plate 130. The outer cover plate 130 is decorative and the assembled locking mechanism of FIG. 1 is secured in the cover plate 130, which cover plate is then secured to the surface of the door. It is an important feature of the invention that the assembled locking mechanism be modular and can be used with any cover (trim).

Referring to FIG. 6C, the locking mechanism of the invention is shown contained in cover plate 130 and is secured against one surface of the door 132. The spindle tail 14 is shown extending from the locking mechanism into the door and connects with a latch mechanism 134. Latch mechanism 134 is conventional and when the thumb-piece 1 is depressed rotating the spindle tail 14, the locking mechanism translates this rotational motion of spindle tail 14 into a linear motion retracting the latch as shown in FIG. 10.

Also shown in FIG. 6C is an inner knob 136 connecting with another spindle tail 154 which likewise connects with latching mechanism 134. These typically operate independently so that turning knob 136 will retract the latch and open the door from the inside. The cover plate 130 containing the latch mechanism is secured to the surface of the door by bolts 144 and 142 as is well known in the art. A cover plate is also shown having a lock 138 which is also a conventional lock. Handle 140 is used in conjunction with the thumb-piece 1 to open and close the door. It will appreciated by those skilled in the art that the spindle tail 14 can be used with all locks and, for example, extend through the door and be connected to a turning knob 136.

Figure 6D:
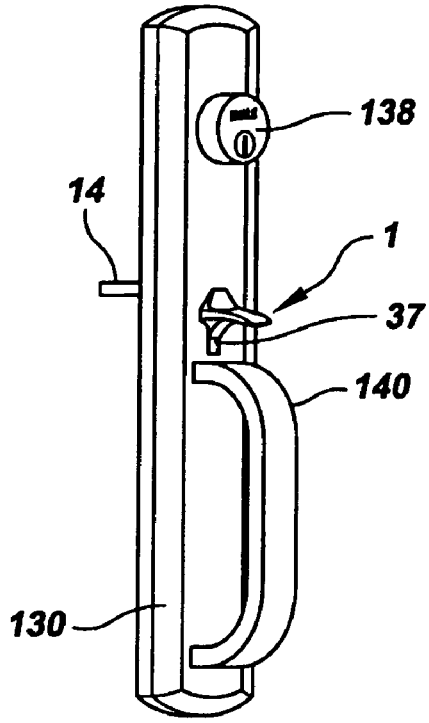
FIG. 6D is a perspective view of FIG. 6C.

Referring now to FIG. 6D, the lock 138, thumb-piece 1, handle 140, and cover plate 130 are shown. As can be seen from FIG. 6B the thumb-piece may be moved up and down in slot 37 and this motion will rotate spindle tail 14 when the door is in the unlocked position.

Figure 7A:
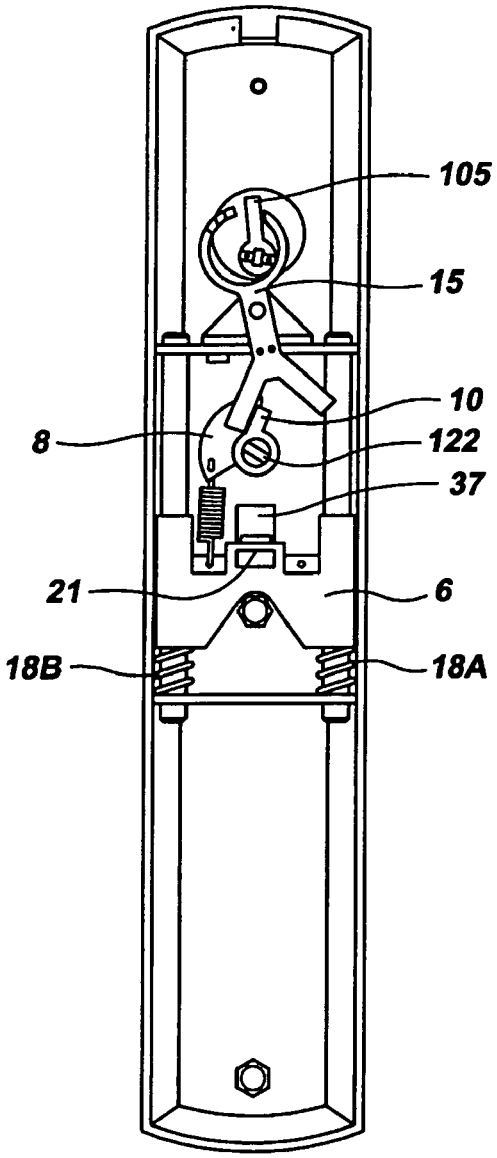
FIG. 7A is a front view of the door latch mechanism of the invention, without the outer plate, with the door in the unlocked position but with the thumb-piece depressed to retract the door latch and to unlatch the door.

Now referring to FIG. 7A, the thumb-piece glide 6 is shown depressed (lowered) because the thumb-piece has been depressed thereby compressing springs 18A and 18B. This movement of the thumb-piece rotates spindle turn plate 8 counter-clockwise thereby turning or rotating spindle tail body shown at its end 122 thereby withdrawing the latch bolt from the latch frame. The door is still in the unlocked condition as shown by the locking tail 15.

Figure 7B:
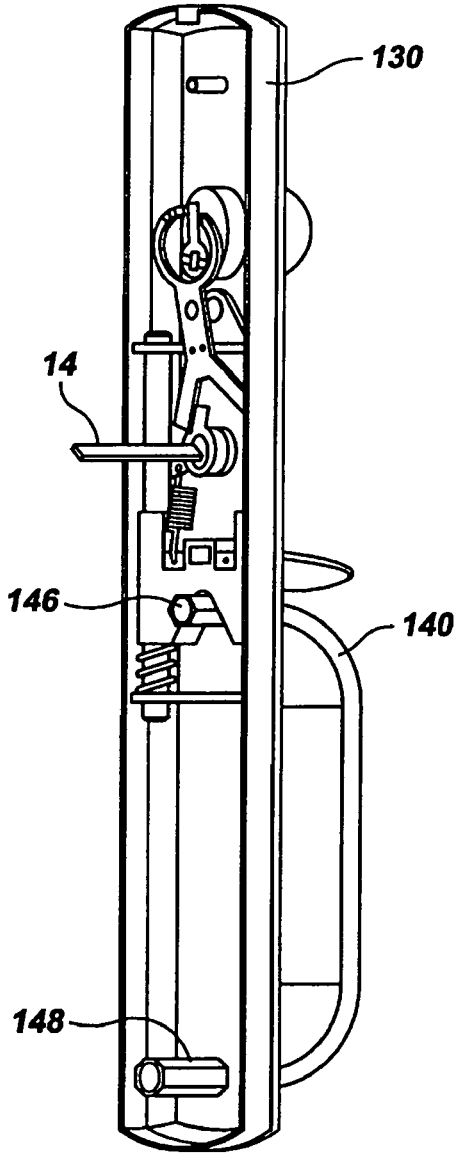
FIG. 7B is a perspective view of FIG. 7A.

Referring now to FIG. 7B, it can be seen that spindle tail 14 has been rotated which will retract the latch bolt from the door frame.

Figure 8:
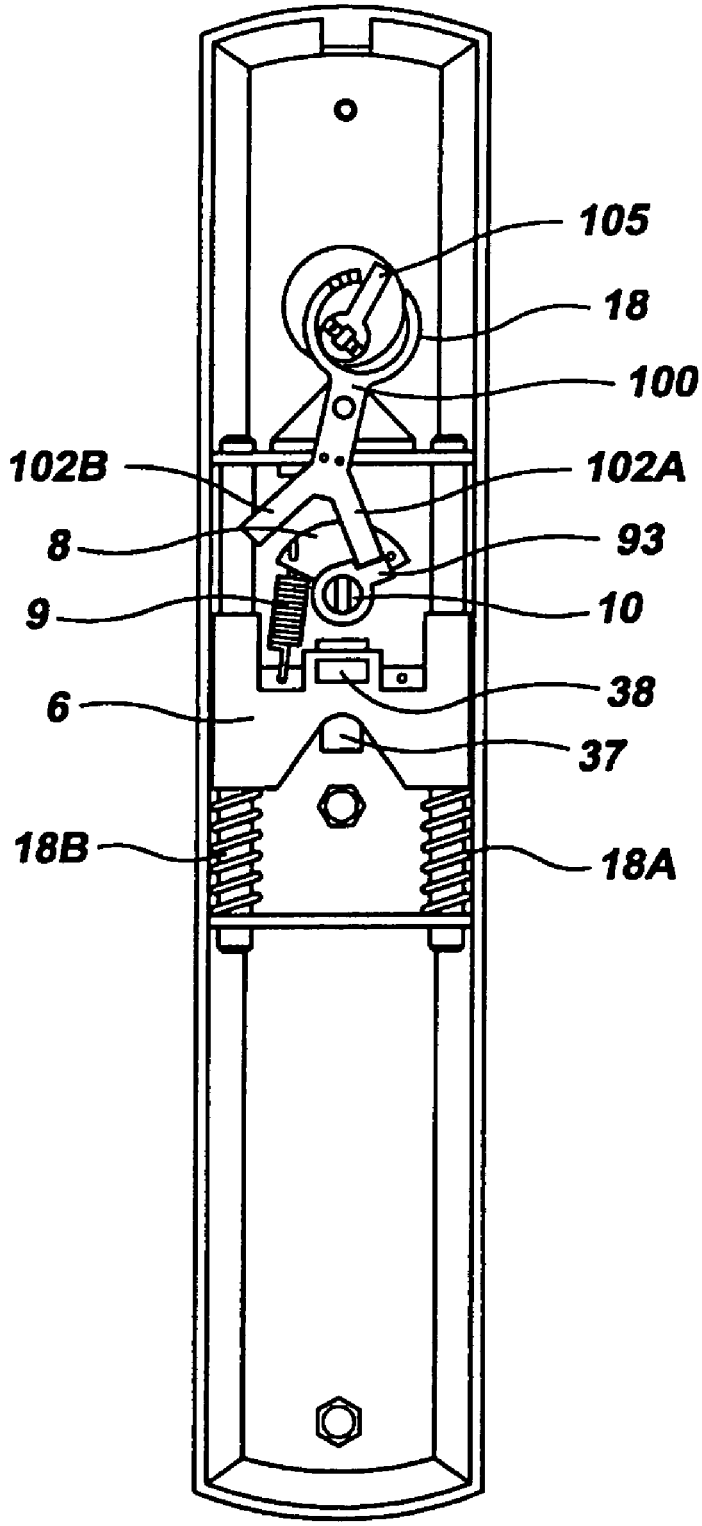
FIG. 8 is a front view of the door latch mechanism of the invention, without the outer plate, with the door in the locked position and the thumb-piece in its normal door latch extended locked position.

In FIG. 8 the door has now been locked and the locking tail body 100 has been moved so that leg 102A now restricts movement of spindle locking tail 10 since the extension 93 of the tail cannot move because it is restricted by leg 102A.

Figure 9:
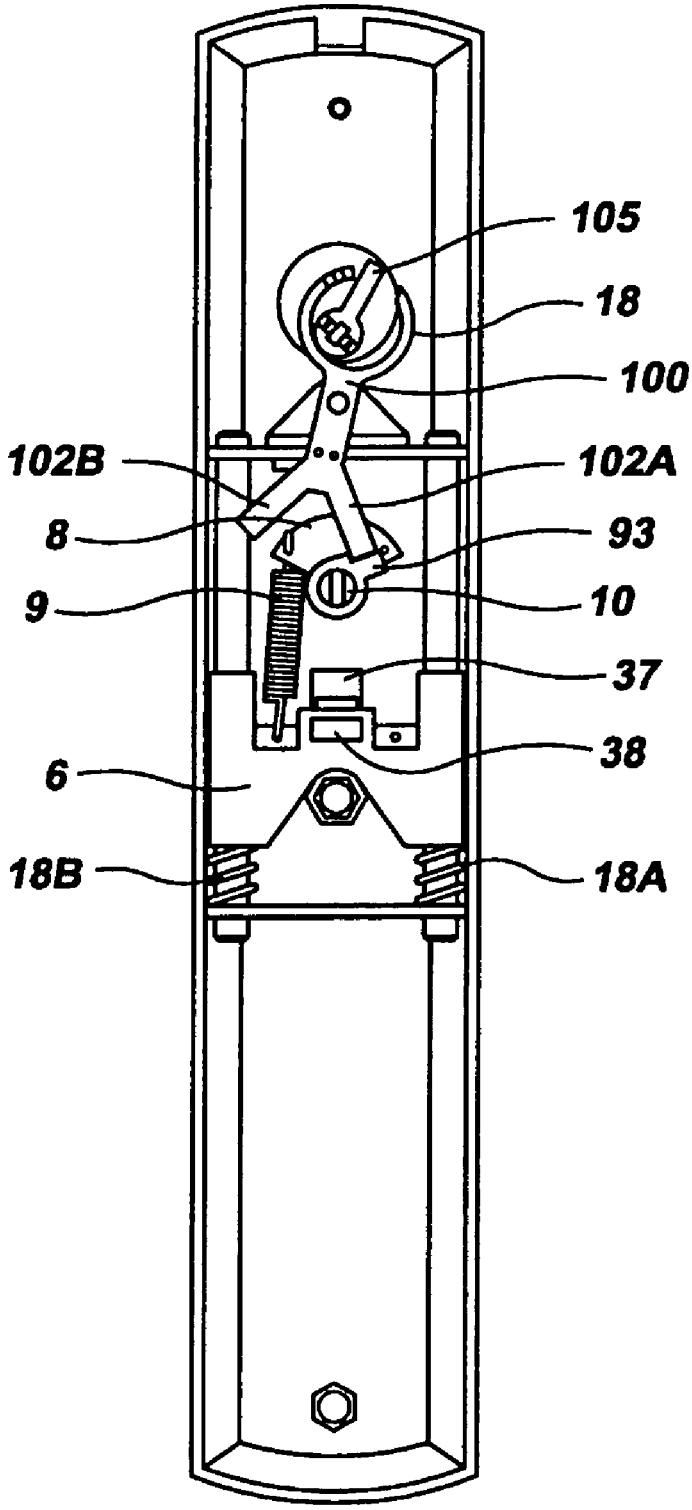
FIG. 9 is a front view of the device of the door latch mechanism of the invention, without the outer plate, with the door in the locked position and the thumb-piece depressed to retract the door latch and to unlatch the door.

In the locked position, when the thumb-piece 1 is depressed, the spindle turn plate will stay in the same position but the thumb-piece guide will be moved downward because of the permissive action of permissive spring 9 as shown in FIG. 9. Thus, the thumb-piece 1 can be moved with the door in the locked position without damaging the door mechanism. As shown in FIG. 9 the permissive spring 9 has been extended, the thumb piece glide 6 depressed to a lower position without any damage to the latch mechanism. If the door latch mechanism of the invention was not used and the thumb-piece was forcibly pressed downward, this might break the mechanism in the door causing damage and requiring replacement of the mechanism. With the mechanism of the invention the thumb-piece is permitted to be moved downward even though the door is in a locked position without any damage to the mechanism of the door.

Referring now to FIG. 10, the mechanism of a typical spindle tail and door latch mechanism is shown. Thus, spindle tail 14 rotates in a door 132 recess to operate a mechanism 134 that in turn retracts bolt or latch 150 rightwardly from door frame 152.

The locking mechanism of the invention can also be configured to retract the latch leftwardly from door frame 152. This can be accomplished by, referring to FIG. 1, positioning the permissive spring 9 in opening 65A of glide 6 and in opening 83A of spindle turn plate 8. As can be seen in this configuration, the spindle turn plate would be rotated clockwise whereas in the position described above, the spindle turn plate would rotate counter-clockwise. This moves the latch bolt either left or right depending on the door configuration.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

Thus, having described the invention, what is claimed is:

1. A thumb-piece latch mechanism which has ergonomic features comprising:

an inner plate and an outer plate which plates are secured together with a latch mechanism therebetween;

a thumb-piece extending into the inner plate and secured to a thumb-piece glide plate in the latch mechanism and which said thumb-piece moves linearly up and down;

said thumb-piece glide plate moveable linearly up and down in the latch mechanism with the thumb-piece when the thumb-piece is moved up and down, respectively;

a spindle rotably mounted to the inner plate;

a spindle turn plate secured to the spindle and which rotates when the spindle is rotated;

a permissive spring having one end connected to the spindle turn plate and the other end connected to the thumb-piece glide plate;

a spindle tail secured to the spindle in the same plane and which rotates when the spindle is rotated; and a latch connected to the spindle tail which moves a latch bolt transversely to the spindle tail when the spindle tail is rotated;

wherein when the thumb-piece is depressed the thumb-piece glide plate is moved downward and the spindle turnplate is rotated, rotating the spindle, and the spindle tail thereby moving the latch bolt transversely from a door frame.

2. The thumb-piece latch mechanism of claim 1 wherein the mechanism is modular and can be used with any suitable cover plate.

3. The thumb-piece latch mechanism of claim 1 wherein the spindle turn plate has two opposed openings to accommodate the permissive spring to enable the turn plate to rotate clockwise or counter-clockwise.

4. The thumb-piece latch mechanism of claim 1 wherein the spindle tail extends into a door and into the latch bolt mechanism within a door frame.

5. The thumb-piece latch mechanism of claim 4 wherein the spindle tail extends through the door.

* * * * *